United States Patent [19]

Leuthold

[11] Patent Number: 4,717,137

[45] Date of Patent: Jan. 5, 1988

[54] APPARATUS AND A METHOD FOR SEPARATING SHEET MATERIAL

[75] Inventor: Karl-Heinz Leuthold, Munich, Fed. Rep. of Germany

[73] Assignee: GAO Gesellschaft fur Automation und Organisation GmbH, Munich, Fed. Rep. of Germany

[21] Appl. No.: 28,042

[22] Filed: Mar. 20, 1987

Related U.S. Application Data

[63] Continuation of Ser. No. 810,765, Dec. 19, 1985, abandoned.

[30] Foreign Application Priority Data

Dec. 21, 1984 [DE] Fed. Rep. of Germany ..... 3446862

[51] Int. Cl.[4] ..... B65H 3/14

[52] U.S. Cl. ..... 271/97; 271/105; 271/122; 271/124; 271/157

[58] Field of Search ..... 271/94, 97, 98, 122, 271/124, 157, 162, 164, 125, 105

[56] References Cited

U.S. PATENT DOCUMENTS

| | | | |
|---|---|---|---|
| 3,210,073 | 10/1965 | Godlewski | 271/125 |
| 4,148,473 | 4/1979 | Johnson | 217/157 |
| 4,236,639 | 12/1980 | Boettge et al. . | |
| 4,324,394 | 4/1982 | Mitzel et al. . | |
| 4,339,221 | 7/1982 | Mitzel et al. . | |
| 4,346,851 | 8/1982 | Bernardini et al. . | |

FOREIGN PATENT DOCUMENTS

| | | | |
|---|---|---|---|
| 2729830 | 1/1979 | Fed. Rep. of Germany . | |
| 2814306 | 10/1979 | Fed. Rep. of Germany . | |
| 2454082 | 5/1983 | Fed. Rep. of Germany . | |
| 55-52835 | 4/1980 | Japan . | |
| 55-52836 | 4/1980 | Japan . | |
| 55-145946 | 11/1980 | Japan | 271/124 |

OTHER PUBLICATIONS

Xerox Disclosure Journal article, vol. 5, No. 6, Nov./-Dec. 1980–"Normal Force System For Magnetic Card Feeder"–Robert A. Johnson.

*Primary Examiner*—Richard A. Schacher

*Attorney, Agent, or Firm*—Sandler & Greenblum

[57] ABSTRACT

A separating apparatus, to which the sheet material is transported in stacks via a stack transporting system, comprises a movable retaining means which reduces the separating gap before the stack is fed and is restored to its original width immediately before separation begins. This allows for the prevention of sheets being wedged in the separating gap, which would otherwise lead to a disturbance of the separation process. The design of a stationary retaining element having an integrated second, movable element allows for the formation of a stopping surface which protrudes beyond the stopping surface of the stationary part and is hit by the leading edges of the sheets in the stack. A toothed design of the new stopping surface allows for the leading edge of the stack of sheet material to be influenced selectively.

18 Claims, 5 Drawing Figures

APPARATUS AND A METHOD FOR SEPARATING SHEET MATERIAL

Figure 1:
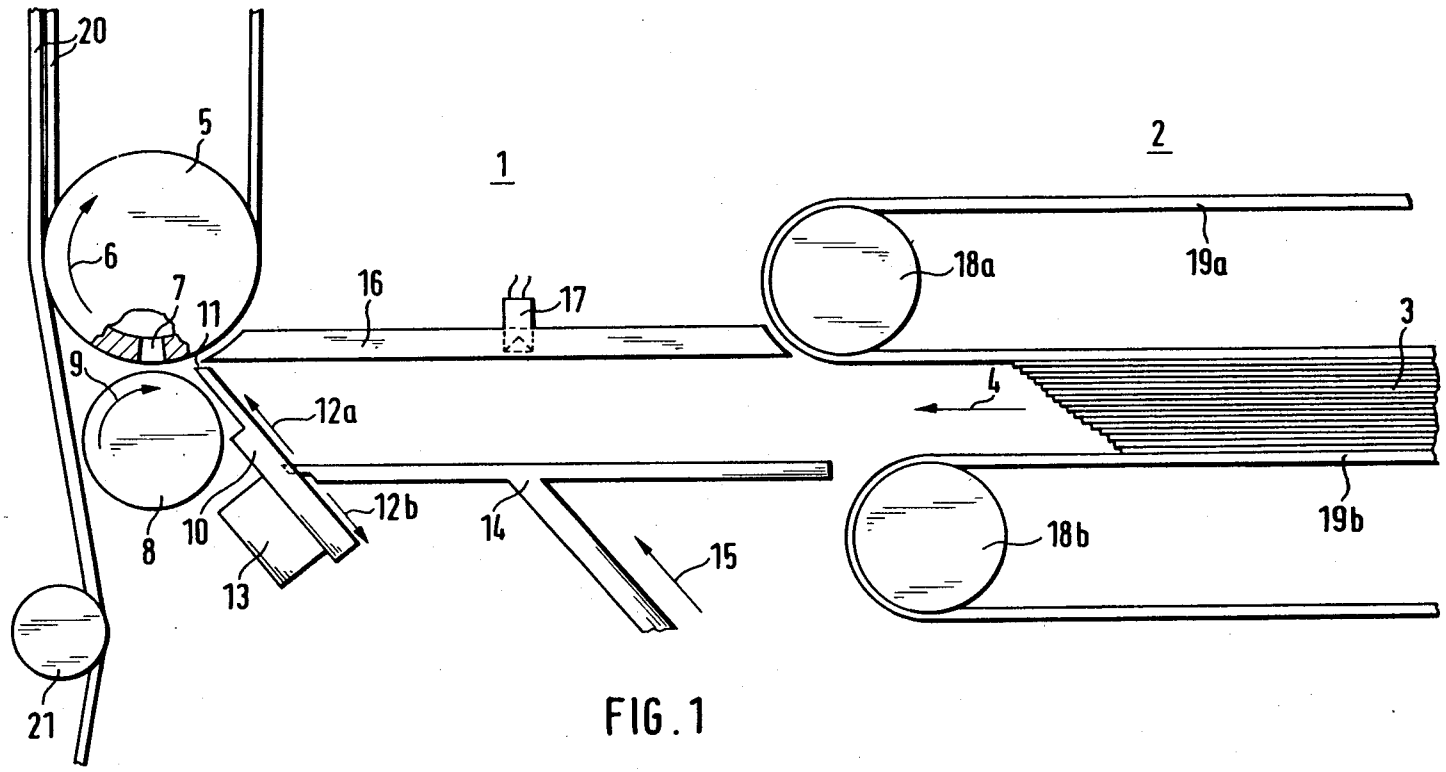

This application is a continuation of application Ser. No. 810,765, filed Dec. 19, 1985, now abandoned.

The present invention relates to an apparatus for separating flat sheet material, for example vouchers, bank notes or the like, the sheet material being transported in the form of a stack via a stack transporting system into a separating apparatus essentially consisting of a withdrawing means, a stack table and a retaining means, then passing in this separating apparatus sheet for sheet through a separating gap set at a predetermined size and formed between the withdrawing means and the retaining means, being grasped by the withdrawing means disposed behind the separating gap and fed to a transport system leading on further.

Many methods and/or apparatus for separating flat sheet material are known.

German Pat. No. 24 54 082, for example, describes a separating apparatus consisting of a separating roller, a retaining roller, a retaining means, a stack table and a feed roller. The feed roller conveys the sheets located on the stack table to the separating roller through a separating gap formed between the separating roller and the retaining means. The separating roller is designed as a suction roller and grasps the leading edges of the sheets to be separated, in order to transfer them successively to a transport system leading on further. In order to prevent double withdrawals, a retaining roller is provided opposite the separating roller, said retaining roller also being designed as a suction roller, rotating in the opposition direction to the separating roller and ensuring that the sheets not lying against the suction roller are pushed back into the stack area. The retaining means, against which the leading edges of the sheets of the stack lie and which together with the separating roller forms the separating gap, ensures that only a limited number of sheets are fed to the separating roller. The retaining means thus effects a kind of pre-separation.

Separating apparatus have also become known in which the individual sheets are fed to the separating roller through the separating gap by aid of a so-called "air conducting plate" (see German Offenlegungsschrift No. 28 14 306).

If separating apparatus of the described type are used in high speed sorters, it is very important for the economy of the equipment that the separating apparatus achieve a high throughput while still separating reliably. This means that not only fast separation of the stack of sheet material must be ensured, but also fast feeding of stacks of sheet material to the separating apparatus. After the last sheet has been separated in the separating apparatus, a new stack of sheet material should be made available on the stack table as fast as possible. In order that the separation proper can begin fast after a new stack of sheet material has been conveyed to the separating apparatus, it is advantageous for a few sheets to already have passed through the separating gap and be pushed forward as far as the separating roller.

It has become apparent that the danger of sheets being wedged in the separating gap increases the faster the stacks transported into the separating apparatus. The consequence is that the separation process is interrupted. Thus, the throughput of the known separating apparatus cannot be crucially improved solely by transporting the stacks to the device faster.

The invention is thus based on the problem of proposing a method for separating flat sheet material by which an essentially higher throughput of stacks of sheet material can be achieved without impairing the reliability of separation.

This problem is solved according to the invention by the features stated in the characterizing part of the main claim.

An essential feature of the invention is that the separating gap is reduced in size before each stack is fed to the separating apparatus and restored to its originally given width immediately before separation begins. Before a stack is fed, the retaining means itself is moved toward the separating roller for this purpose, for example. Several sheets can still be wedged in the separating gap which is now smaller, but this is unimportant since the separating gap is reset to its original width immediately before separation begins, thereby eliminating any wedging which might have taken place.

An advantage of the inventive solution is that the throughput of stacks of sheet material in the separating apparatus can be considerably increased without impairing the reliability of separation by a constructionally simple measure. As soon as the last sheet has been separated in the separating apparatus, a new stack of sheet material can be conveyed into the apparatus at high speed without any wedging of sheets in the separating gap interfering with the separation process.

According to an advantageous development of the invention, the width of the separating gap is not only reduced, but the surface of the retaining means which shapes the leading edge of the stack is also temporarily changed before each stack runs into the separating apparatus. For this purpose, the retaining means includes not only a stationary part but also a movable part. This part can be controlled in such a way as to create a stopping surface which protrudes beyond the stationary part of the retaining means and is hit by the leading edge of the stack of sheet material being conveyed to the device. When this stopping surface is withdrawn into the stationary part of the retaining means immediately before separation begins, a free gap remains between the leading edge of the stack and the stationary part, allowing for the stack to be fed forward, as is necessary for separation, without friction on the retaining means.

The movable part of the retaining means can also have a toothed or roughened design on the side coming in contact with the leading edge of the stack.

The advantage of temporarily activating a separate movable element having an appropriately designed surface is that the leading edge of the stack being conveyed to the device fast can be influenced without interfering with the separation itself. For example, a toothed surface prevents the leading edges of individual sheets from pushing along the retaining means in front of the leading edges of other sheets and thereby disturbing the separation process. The movable element is removed from the leading edge of the sheet before separation begins so that the stack can be fed forward, as is necessary for separation, without any disturbance.

Further advantages and developments of the invention can be found in the subclaims and in the following description of embodiments of the invention with reference to the adjoined drawings.

Figure 2:
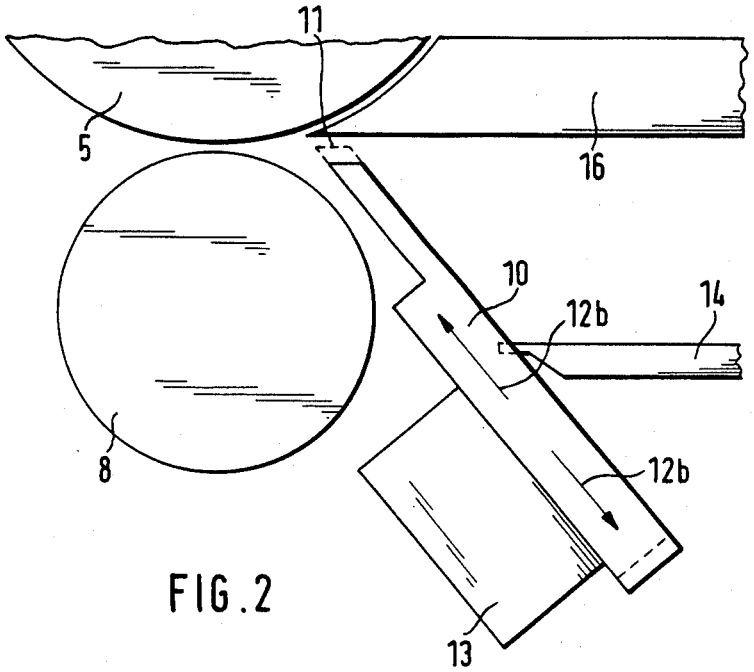
Figure 3A:
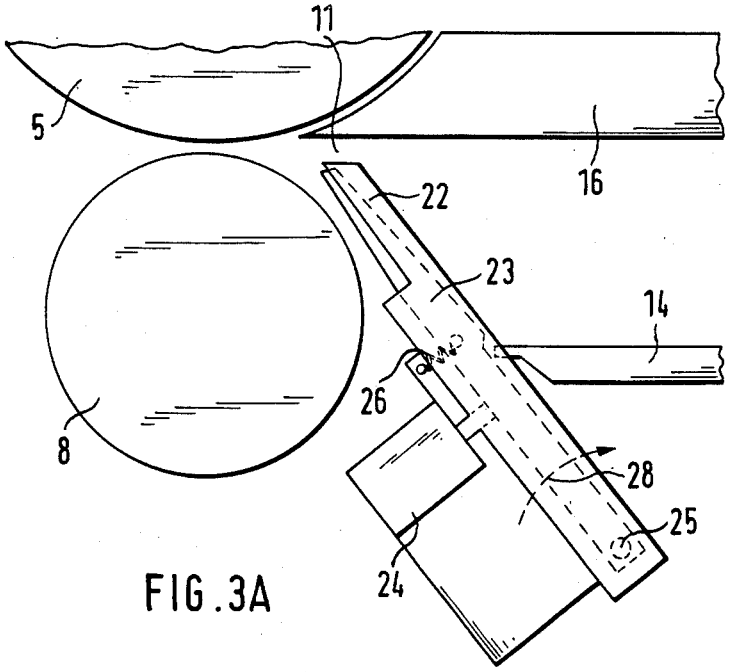
Figure 3B:
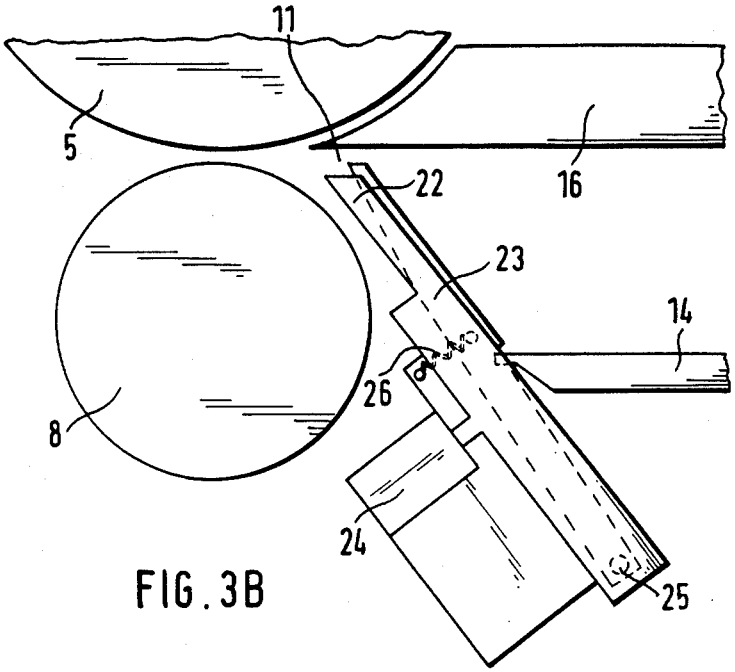
Figure 4:
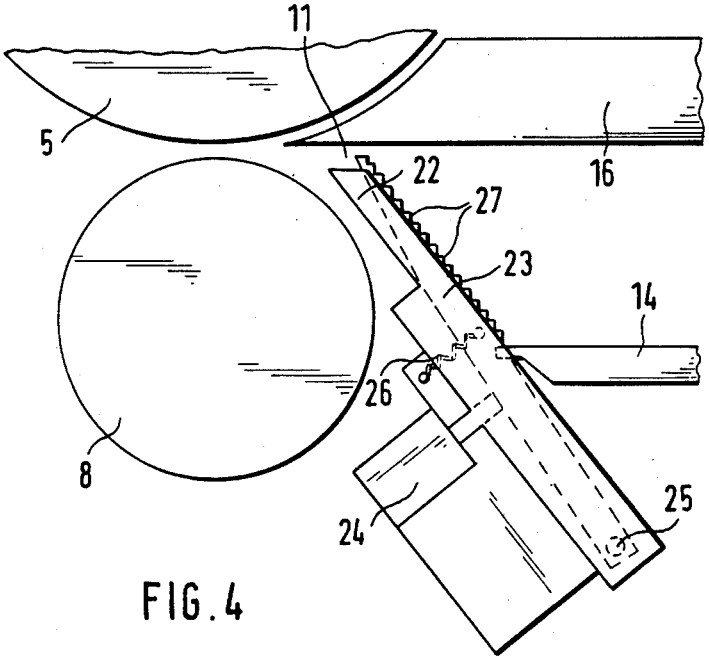

These show:

FIG. 1 a side view of the separating apparatus and a transport system for stacks of sheet material FIG. 2 a cutaway portion of the separating apparatus seen from the side having a movable retaining means in the working position and the position of rest FIG. 3*a* a cutaway portion of the separating apparatus seen from the side having a stationary part of the retaining means and a movable part of the retaining means, the movable part being in the position of rest FIG. 3*b* like FIG. 3*a* except that the movable part of the retaining means is in the working position FIG. 4 a development of FIG. 3*b* in which the surface of the movable part of the retaining means is roughened FIG. 1 shows, in an exemplary embodiment, a separating apparatus 1 as is used, for example, in high speed sorting machines. A stack 3 of sheet material is conveyed by a stack transporting system 2 to the separating apparatus whenever the last sheet of the previous stack has been separated.

The separating apparatus essentially consists of a pressure plate 14, a forward feed means 16, a separating roller 5, a retaining roller 8 and a retaining means 10, referred to as a retaining element in the following.

Pressure plate 14 takes over the stacks 3 of sheet material arriving on the stack transporting system 2 consisting of belts 19*a*, 19*b* and transport rollers 18*a*, 18*b*, and conveys them to forward feed means 16, which is designed as an air conducting plate, for example. The sheets are transported sequentially to separating roller 5 by aid of air conducting plate 16, which has air blast holes to be supplied with air blasts arranged therein in such a way as to give the sheet which is uppermost in the stack at the moment a movement component in the direction of separation. By means of suction openings 7 in separating roller 5, the leading edges of the sheets are grasped and transferred by rotation in the direction of arrow 6 to the following transport system consisting of belts 20 and transport roller 21.

During separation the leading edges of the sheets lie on retaining element 10, whereby a gap 11 of predetermined size is set between the retaining element and separating roller 5 or air conducting plate 16 so that only the upper sheets lying directly against air conducting plate 16 are ever conveyed to separating roller 5, if possible.

Opposite separating roller 5 there is retaining roller 8 which rotates in the direction of arrow 9 contrary to the direction of separation and has suction openings distributed along its periphery. The sheets which have already been transported through separating gap 11 by means of air conducting plate 16 are held back by retaining roller 8 rotating contrary to the direction of separation so that separating roller 5 only separates the uppermost sheet of the stack in each case. Reference is made to German offenlegungsschrift No. 28 14 306 for details of the separating apparatus described only briefly here.

Irrespective of a specific separating apparatus, the essential features of the invention lie in the special design and control of the retaining element, which shall be explained in the following with reference to the figures.

In order to ensure a high throughput of stacks of sheet material in the separating apparatus, it is necessary that a new stack of sheets to be separated is made available as fast as possible as soon as the last sheet of the preceding stack has left the separating apparatus. This is effected by aid of stack transporting system 2, shown in FIG. 1. The stack transporting system may be designed in such a way that its lower belts 19*b* run somewhat more slowly than upper belts 19*a*. This allows the sheets located at the bottom of the stack to be displaced with respect to the sheets thereabove, thereby creating a wedge-shaped leading edge of the stack pointing in direction of transport 4. This measure serves the purpose of prepositioning the leading edges of the sheets in the shape necessary for separation. When the packet conveyed to the device has left the stack transporting system, its further transport up to retaining element 10 on pressure plate 14 is effected in a sliding manner solely by the mass inertia of stack 3.

Due to the fast conveyance of the stack of sheet material to the device, several sheets can already advance as far as the separating or retaining roller in accordance with the width set for separating gap 11, which is quite desirable. However, in order to rule out any wedging of individual sheets in the separating gap when a stack is running into the separating apparatus, retaining element 10 is arranged movably, as shown in FIG. 2. FIG. 2 shows not only the above-mentioned elements of the separating apparatus but also a control means 13 connected with retaining element 10 for moving the element in accordance with arrows 12*a*, 12*b* shown. A motor with a reversible direction of revolution, for example, may be used to move the retaining element, said motor being equipped with an appropriate transmission and performing the desired translational motion. As soon as the last sheet of a stack has been separated, which can be ascertained using a light barrier 17 (see FIG. 1), transport system 2 is activated to feed a further stack, on the one hand, and retaining element 10 is moved in the direction of arrow 12*a* into the working position shown by dotted lines, on the other hand. As soon as the stack of sheet material is lying on the stack table with its leading edge on the retaining element, the separation process is started.

Before separating roller 5 withdraws the first sheet from the stack, retaining element 10 is moved in the direction of arrow 12*b* into the position of rest, thereby ensuring that any wedging of sheets in the separating gap which may have come about is eliminated. During the separation process, stack table 14 is successively moved in the direction of arrow 15 (see FIG. 1) by a driving means not shown in FIG. 1, so that the stack of sheet material is always lying against air conducting plate 16. In this phase it is unlikely that sheets of the conventional quality will again be wedged in the separating gap since the gap width is now set in such a way that the sheets conveyed by the air conducting plate can pass through separating gap 11 reliably without any jamming.

FIGS. 3*a* and 3*b* show a further embodiment of the invention provided not only with a stationary retaining element 22 but also with a second, movable element 23. FIG. 3*a* shows this element in the position of rest, and FIG. 3*b* shows it in the working position.

The second, movable element 23 may be moved by an appropriate control unit 24, such as an electromagnet, via a fulcrum 25 against the force of a spring 26 in the direction of arrow 28. Element 23 is then located in the working position shown in FIG. 3*b*. When the excitation of the electromagnet is switched off, element 23 moves into the position of rest shown in FIG. 3*a* due to the spring force. The stationary retaining element 22 proper preferably has a rake-like design with several interconnected movable elements 23 interlocking in a comb-like fashion in several gaps of the rake.

If element 23 is controlled by aid of a step motor, for example, the reduction in the width of the separating gap can be set in many steps virtually as one pleases going as far as the complete closure of the gap. The separating gap may thus be adapted to the particular requirements of the sheet material, such as the sheet thickness, the quality of the paper, etc.

The control of movable element 23 and the related change in separating gap 11 in accordance with the arrival of stacks and separation are effected as described in connection with FIG. 2. However, the use of an additional, movable element further allows for the leading edge of the stack of sheet material to be influenced additionally during specific operating sequences.

As can be seen in particular in FIG. 3*b*, element 23 is designed in such a way so as to protrude out of stationary retaining element 22 in the working position in the direction of the leading edge of the stack to be expected. The protruding surface of element 23 which shapes the leading edge of the stack of sheet material being conveyed to the device is parallel to the corresponding surface of stationary retaining element 22. When movable element 23 is moved into the position of rest after a stack of sheet material has been fed, the leading edge of the stack of sheet material is lying a small distance away parallel to the surface of stationary retaining element 22. The gap thereby coming about between the leading edge of the stack and retaining element 22 is advantageous in that the leading edges of the individual sheets may be conveyed by successive raising of pressure plate 14 to air conducting plate 16 without friction on the stopping surface of retaining element 22.

It is also basically possible to produce a gap using retaining element 10 described with reference to FIG. 2 if it is pivoted about a fulcrum toward the leading edge of the stack to set the working position. Each embodiment avoids any extremely worn sheets, for example, getting caught on the retaining element when being raised to the air conducting plate and sliding off contrary to the direction of feed. This would lead to air conducting plate 16 not being able to convey such sheets and those following them through separating gap 11 to separating roller 5.

This disturbance may arise in the case of particularly flaccid, extremely worn sheets even when the stack of sheet material conveyed to the device at high speed hits the retaining element with its leading edge.

In order to avoid this potential disturbance, movable element 23 is provided with a special surface on the side cooperating with the leading edge of the stack. As shown in FIG. 4, element 23 may be provided with a toothing 27 consisting of several steps which is designed in such a way that the depths of the steps extend parallel to air conducting plate 16 and the heights of the steps, which are hit by the leading edges of the sheets, extend perpendicular to air conducting plate 16. Toothing 27 may have a different height and a different number of steps depending on the sheet thickness and the paper quality of the sheets to be separated. In FIG. 4 the entire surface acting on the leading edge of the stack has a toothed surface. Depending on the requirements, the toothing may be provided only in the area of the separating gap or only in the center area of element 23. Immediately before separation begins, the movable retaining element is moved into the position of rest so that the toothing does not affect the separation process itself.

I claim:

1. An apparatus for separating individual sheets of flat sheet material such as flat vouchers, bank notes or similar articles from a stack of said sheets, which material is transported in a stack of said flat sheets by a stack transporting system, said separating apparatus comprising a stacking table, means for retaining said sheets on said stacking table, and means for withdrawing individual sheets from said stack, wherein a separating gap of a predetermined size is located between said withdrawing means and said retaining means, said withdrawing means being positioned at least partially behind said separating gap and comprising means for feeding said individual sheets to a sheet transporting system, said apparatus further comprising means for reducing the size of said separating gap before each stack of sheet material is conveyed to said separating apparatus, means for increasing said predetermined gap size after each stack is conveyed, means for maintaining said increased size of said separating gap while said individual sheets are being separated from said stack of sheet material, said retaining means including a substantially stationary member having a movable member positioned thereon, wherein said movable member is controlled by said means for reducing the size of said separating gap, said gap size reducing means comprising driving means for controlling said movable member.

2. An apparatus for separating individual sheets from stacks of said material in accordance with claim 1 further comprising means for changing the width of said separating gap before each stack of sheet material is conveyed to said device, means for moving said retaining means towards the leading edge of said stack to be received and means for moving said retaining means back to a position which said retaining means occupied before separation of a given stack of sheet material.

3. An apparatus in accordance with claim 1 wherein said driving means comprises a stepping motor.

4. An apparatus in accordance with claim 1, wherein said predetermined gap size is sufficiently large so as to permit at least one individual sheet to pass therethrough.

5. Apparatus for separating individual sheets from a stack of flat sheet material which is being transported by a stack transportation system toward said separating apparatus, said separating apparatus comprising a stack table, means for retaining each said stack on said table, and means for withdrawing individual sheets from said stack through a separating gap formed between said withdrawing means and said retaining means, at least a part of said withdrawing means being positioned behind said separating gap, as viewed in the direction of travel of said stack of sheets, and comprising means for feeding said individual sheets to an individual sheet transportation system, said apparatus further comprising means for reducing the size of said separation gap to a predetermined size before a given stack of sheet material is conveyed to said separating apparatus, means for increasing said gap size before an individual sheet is withdrawn from said stack, and means for maintaining said increased gap size at a fixed value while said individual sheets are being separated from said stack.

6. An apparatus for separating individual sheets of flat sheet material from a stack of sheet material in accordance with claim 5 further comprising means for moving said retaining means towards a leading edge of each stack before said stack is transported to said apparatus and means for shifting said retaining means back to its original position prior to separation.

7. An apparatus for separating individual sheets from a stack of flat sheet material in accordance with claim 5 further comprising a motor for moving said retaining means towards and away from said withdrawing means.

8. An apparatus for separating individual sheets of flat sheet material from a stack of said sheet material in accordance with claim 5, wherein said retaining means is pivotally attached to a support.

9. An apparatus for separating individual sheets of flat sheet material from a stack of said flat sheet material in accordance with claim 5, wherein said retaining member includes a stationary portion, a movable portion, and a motor for moving said movable portion of said retaining means to reduce the separating gap.

10. An apparatus in accordance with claim 9 wherein said movable member is adapted to be pivoted by said motor towards said leading edge of said stack of sheet material.

11. An apparatus for separating individual sheets of flat sheet material from a stack of said material in accordance with claim 10, wherein said movable member includes a surface which comprises means for abutting said leading edge of said stack which is positioned in a parallel fashion with respect to a corresponding surface on the stationary portion of said retaining means.

12. An apparatus for separating individual sheets of flat sheet material from a stack of said material in accordance with claim 9 wherein said movable member has a surface adapted to contact the leading edge of said stack, said surface being at least partially roughened.

13. An apparatus for separating individual sheets of flat sheet material from a stack of said material in accordance with claim 12 wherein said roughened surface has a plurality of steps or teeth thereon.

14. An apparatus for separating individual sheets of flat sheet material from a stack of said material in accordance with claim 9, wherein said movable portion of said retaining means is moved by a stepping motor.

15. An apparatus for separating individual sheets of flat sheet material from a stack of said material in accordance with claim 5, wherein said withdrawing means comprises at least one rotatable roller positioned at least partially rearwardly of said separating gap.

16. An apparatus in accordance with claim 15 wherein said separating roller has a plurality of suction apertures for grasping leading edges of said sheets of material from said stack when said sheets are withdrawn from said stack.

17. An apparatus in accordance with claim 5 wherein said stacking table is movable from a bottom edge of said retaining means towards said separating gap as said sheets in said stack are withdrawn from said stack.

18. An apparatus in accordance with claim 5 wherein said predetermined size of said separation gap before a given stack of sheet material is conveyed to said separating apparatus is sufficiently large so as to permit at least one individual sheet to pass therethrough.

* * * * *